US006892488B1

(12) United States Patent
Serravalle

(10) Patent No.: US 6,892,488 B1
(45) Date of Patent: May 17, 2005

(54) ILLUMINATING RECOIL GUIDE ROD

(76) Inventor: Robert P Serravalle, 129 Park Ave., Hicksville, NY (US) 11801

( * ) Notice: Subject to any disclaimer, the term of this patent is extended or adjusted under 35 U.S.C. 154(b) by 0 days.

(21) Appl. No.: 10/701,843

(22) Filed: Nov. 4, 2003

(51) Int. Cl.[7] ..... F41G 1/36

(52) U.S. Cl. ..... 42/113; 42/114; 42/115; 42/117; 42/146

(58) Field of Search ..... 42/113, 114, 115, 42/117, 146

(56) References Cited

U.S. PATENT DOCUMENTS 3,938,875 A * 2/1976 Ruder ..... 42/113
4,375,135 A * 3/1983 Wigger ..... 42/1.01
4,677,782 A * 7/1987 Kaye et al. ..... 42/132
4,680,012 A * 7/1987 Morley et al. ..... 434/22
4,786,966 A * 11/1988 Hanson et al. ..... 348/158
4,934,086 A * 6/1990 Houde-Walter ..... 42/115
5,005,308 A * 4/1991 Parks ..... 42/122
5,040,885 A * 8/1991 Simms ..... 359/399
5,373,644 A * 12/1994 DePaoli ..... 42/113
5,487,234 A * 1/1996 Dragon ..... 42/70.07
5,548,915 A * 8/1996 Szarmach et al. ..... 42/70.11
5,685,636 A * 11/1997 German ..... 362/259
5,715,623 A * 2/1998 Mackey, III ..... 42/1.01
5,834,676 A * 11/1998 Elliott ..... 89/41.05
6,385,894 B1 * 5/2002 Podvin ..... 42/146
6,591,536 B2 * 7/2003 Houde-Walter et al. ..... 42/114
6,641,277 B2 * 11/2003 Smith ..... 362/111
6,675,521 B1 * 1/2004 Kim ..... 42/114

* cited by examiner

*Primary Examiner*—Michael J. Carone
*Assistant Examiner*—John Richardson
(74) *Attorney, Agent, or Firm*—Michael I. Kroll

(57) ABSTRACT

The present invention 10 discloses an illuminating recoil guide rod for use on a handgun 12 modified to include a highly illuminating LED or infrared light 26 for a night vision light source, a tilt or mercury switch 22 that will allow for user selectable starting angles of illumination when the firearm is drawn from the holster comprising a lens 24, battery or batteries 30, housing compartment 32, mercury angle switch 28, electronics 56, 58 and a manual on/off switch 28. The illuminating recoil guide rod 10 of the present invention is completely unobtrusive and is activated simply by drawing the firearm 12 from the holster and raising the barrel 36. The present invention provides for an additional element in the form of a wireless transmitter 56 and receiver 58 for illuminating the LED 26 only while a pressure sensitive pad 60 is depressed.

6 Claims, 14 Drawing Sheets

ILLUMINATING RECOIL GUIDE ROD

BACKGROUND OF THE INVENTION

1. Field of the Invention

The present invention relates generally to guns and, more specifically, to an illuminating recoil guide rod, most typical for semi automatic pistols, modified to include a highly illuminating LED light or infrared for night vision source, a tilt or mercury switch that will allow for user selectable starting angles of illumination when the firearm is drawn from the holster comprising a lens, battery or batteries, housing compartment, mercury switch, electronics and a manual on/off switch.

The illuminating recoil guide of the present invention is completely unobtrusive and is activated simply by drawing the firearm from the holster and raising the barrel for activation. A kit is provided having a manual shut off adjustable angle activation switch that can be set by the user to a desired activation angle. This switch also acts as a master shut off switch.

The device of the present invention will be especially effective in dimly lit environments, as the pistol is drawn, the light illuminates per user selected angle of illumination without any other motions, giving the user sufficient light to aid in assessing the situation and potential threat while leaving the other hand free to deal with other obstacles as needed.

The present invention provides for an additional element in the form of a wireless transmitter and receiver for illuminating the LED while a pressure sensitive pad is depressed. Once pressure is removed the LED is shut off.

2. Description of the Prior Art

There are other illuminating devices designed for use with firearms, which require alteration of the firearm to mount an illuminating device or use both hands, one to hold the firearm and the other to hold a light source.

While these illuminating devices may be suitable for the purposes for which they where designed, they would not be as suitable for the purposes of the present invention as heretofore described.

It is thus desirable to provide an illuminating recoil guide rod, most typical for semi automatic pistols, including a highly illuminating LED light or infrared for night vision, a tilt or mercury switch that will allow for various angles of illumination when the firearm is drawn from the holster, a lens, battery or batteries, housing compartment, electronics and a manual on/off switch.

The illuminating recoil guide rod of the present invention is completely unobtrusive and is activated simply by drawing the firearm from the holster and raising the barrel for activation. A kit is provided having an adjustable angle activation switch that can be set by the user to a desired activation angle. This switch also acts as a manual shut off switch.

The device of the present invention will be especially effective in dimly lit environments, as the pistol is drawn, the light automatically illuminates without any other motions, giving the user sufficient light to aid in assessing the situation and potential threat while leaving the other hand free to deal with other obstacles as needed.

SUMMARY OF THE PRESENT INVENTION

The present invention discloses an illuminating recoil guide rod for use on a handgun, modified to include a highly illuminating LED or infrared light for a night vision light source, a tilt or mercury switch that will allow for user selectable starting angles of illumination when the firearm is drawn from the holster comprising a lens, battery or batteries, housing compartment, mercury angle switch, electronics and a manual on/off switch. The illuminating recoil guide rod of the present invention is completely unobtrusive and is activated simply by drawing the firearm from the holster and raising the barrel. The present invention provides for an additional element in the form of a wireless transmitter and receiver for illuminating the LED only while a pressure sensitive pad is depressed.

A primary objective of the present invention is to provide a first embodiment having an illuminating recoil guide rod that is most typical of semi automatic pistols, modified to include a highly illuminating LED light.

Another objective of the present invention is to provide a first embodiment having an illuminating recoil guide rod that provides a tilt or mercury switch that will allow for various angles of illumination when the firearm is drawn from the holster.

Yet another objective of the present invention is to provide a first embodiment having an illuminating recoil guide rod that includes a lens, battery or batteries, housing compartment and electronics.

Still yet another objective of the present invention is to provide a first embodiment having an illuminating recoil guide rod having a master on/off switch.

Another objective of the present invention is to provide a first embodiment having an illuminating recoil guide rod that provides an adjustable angle activation switch that can be set at a desired angle of activation and serves as a master shut off switch.

Yet another objective of the present invention is to provide a first embodiment having an illuminating recoil guide rod that is completely unobtrusive and is activated simply by drawing the firearm from the holster and raising the barrel for activation.

Another objective of the present invention is to provide a second embodiment having a recoil guide rod comprised of a lens, highly illuminating LED light, battery or batteries, a wireless transmitter and receiver and is a cordless activation device that may be placed anywhere on the firearm to activate the recoil guide rod light.

Additional objective of the present invention will appear as the description proceeds.

The present invention overcomes the shortcomings of the prior art by providing a first embodiment having an illuminating recoil guide rod that is most typical of semi automatic pistols, modified to include a highly illuminating LED light or infrared for night vision source, a tilt or mercury switch that will allow for various angles of illumination when the firearm is drawn from the holster, a lens, battery or batteries, housing compartment, electronics and a master on/off switch.

The recoil guide of the present invention is completely unobtrusive and is activated simply by drawing the firearm from the holster and raising the barrel for activation. A kit is provided having an adjustable angle activation switch that can be set by the user to a desired activation angle. This switch also acts as a master shut off switch.

The device of the present invention will be especially effective in dimly lit environments, as the pistol is drawn, the light automatically illuminates without any other motions, giving the user sufficient light to aid in assessing the situation and potential threat while leaving the other hand free to deal with other obstacles as needed.

Also to provide a second embodiment having a recoil guide rod comprised of a lens, highly illuminating LED light, battery or batteries, a wireless transmitter and receiver and is a cordless activation device that may be placed anywhere on the firearm to activate the recoil guide rod light.

The foregoing and other objectives and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
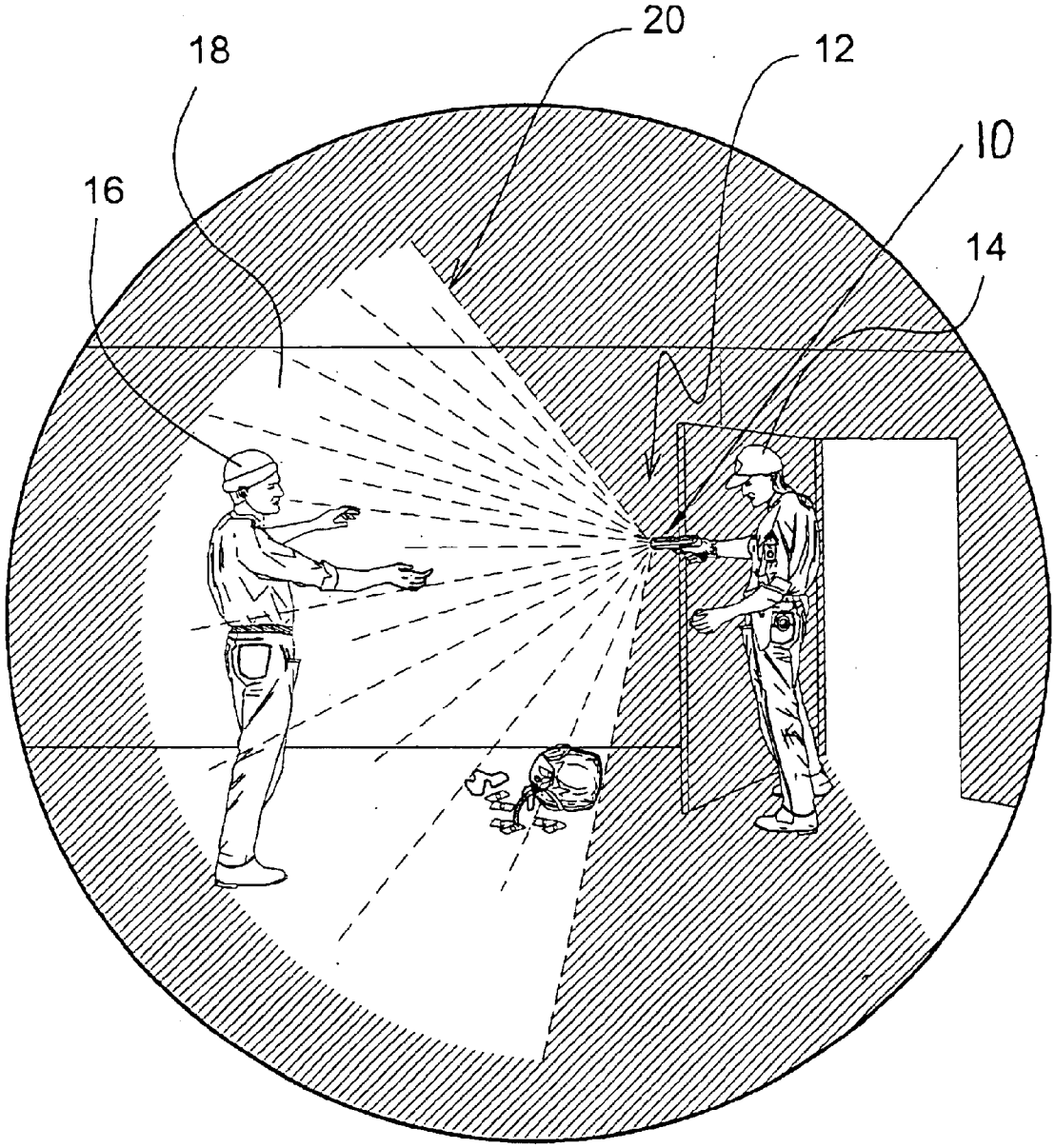
FIG. 1 is an illustrative view of the present invention in use.

With regard to reference numerals used, the following numbering is used throughout the drawings.

10 present invention
12 handgun
14 user
16 target
18 light beam
20 angle
22 tilt or mercury switch
24 lens
26 LED
27 dial
28 illumination angle switch
29 dial
30 battery
32 housing
34 slide
36 barrel
38 holstered position
40 drawn position
42 recoil spring
44 end cap
46 mercury
48 contact
50 plate
52 ports
54 angle adjustment
56 transmitter
58 receiver
60 transmitter pad
62 off position.

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention in use by an individual user 14. The present invention relates generally to automatic handguns 12 and specifically to an illuminating recoil guide rod that has illumination means for illuminating a target 16. The illuminating recoil guide rod will automatically activate the self-contained illuminating means to provide light 18 when the firearm 12 is drawn from the holster. The angle 20 within which the illumination 18 will be activated is user adjustable. The illumination means may also be shut off so that it will not automatically activate. The illuminating recoil guide rod of the present invention is completely unobtrusive and is activated simply by drawing the firearm 12 from the holster and raising the barrel for activation.

Figure 2:
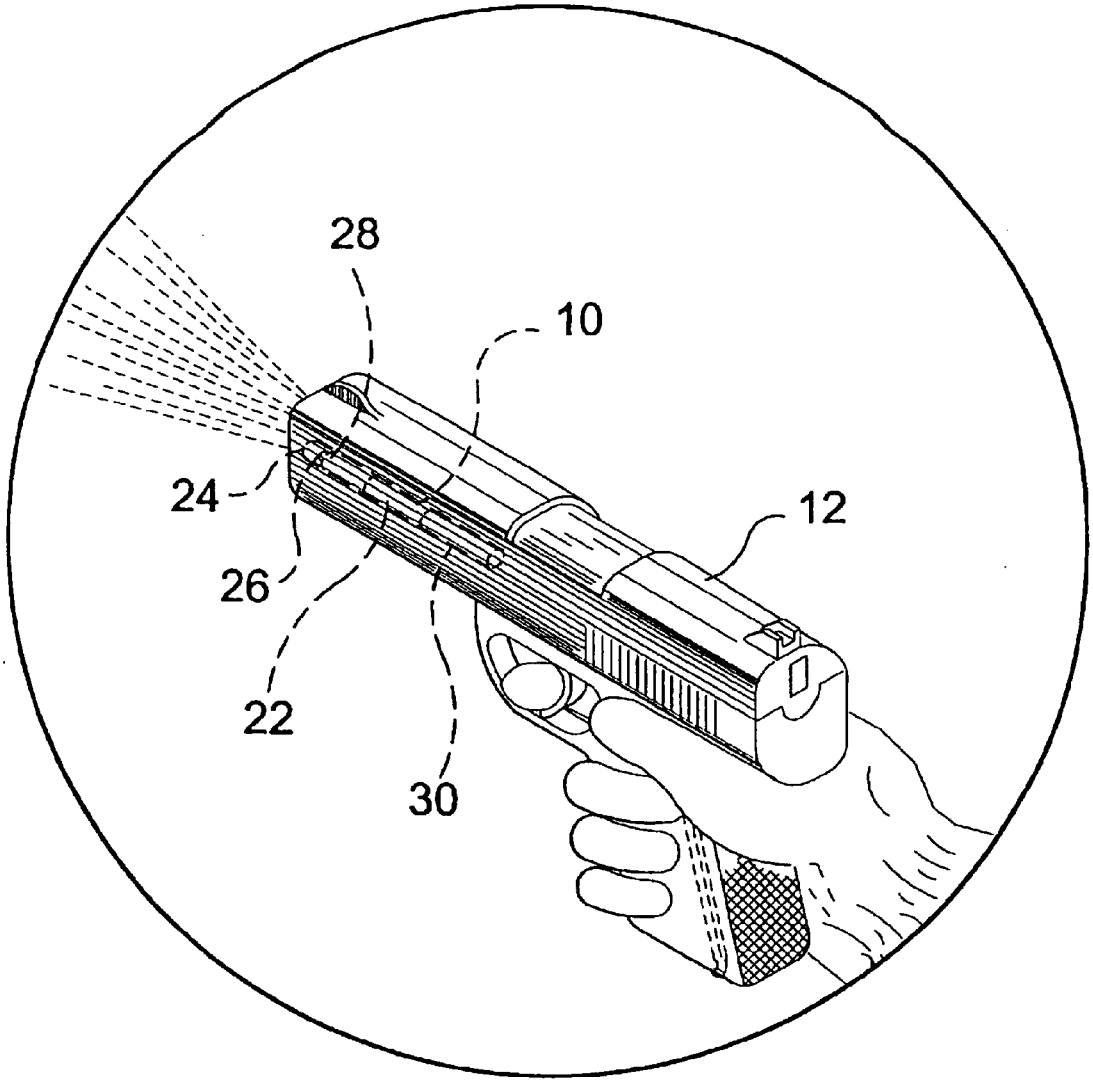
FIG. 2 is a perspective view of the present invention in use.

Turning to FIG. 2, shown therein is a perspective view of the present invention 10 in use. The present invention 10 is comprised of a minimally modified illuminating recoil guide rod most typical of a semi automatic pistol 12. The device 10 is completely unobtrusive and does not alter the weapon 12 other than providing an illuminating, tilt or mercury switch 22 activated light to its features. Also shown are a lens 24, light emitting diode (LED) 26, manual shutoff and angle adjustment switch 28 and battery 30.

Figure 3:
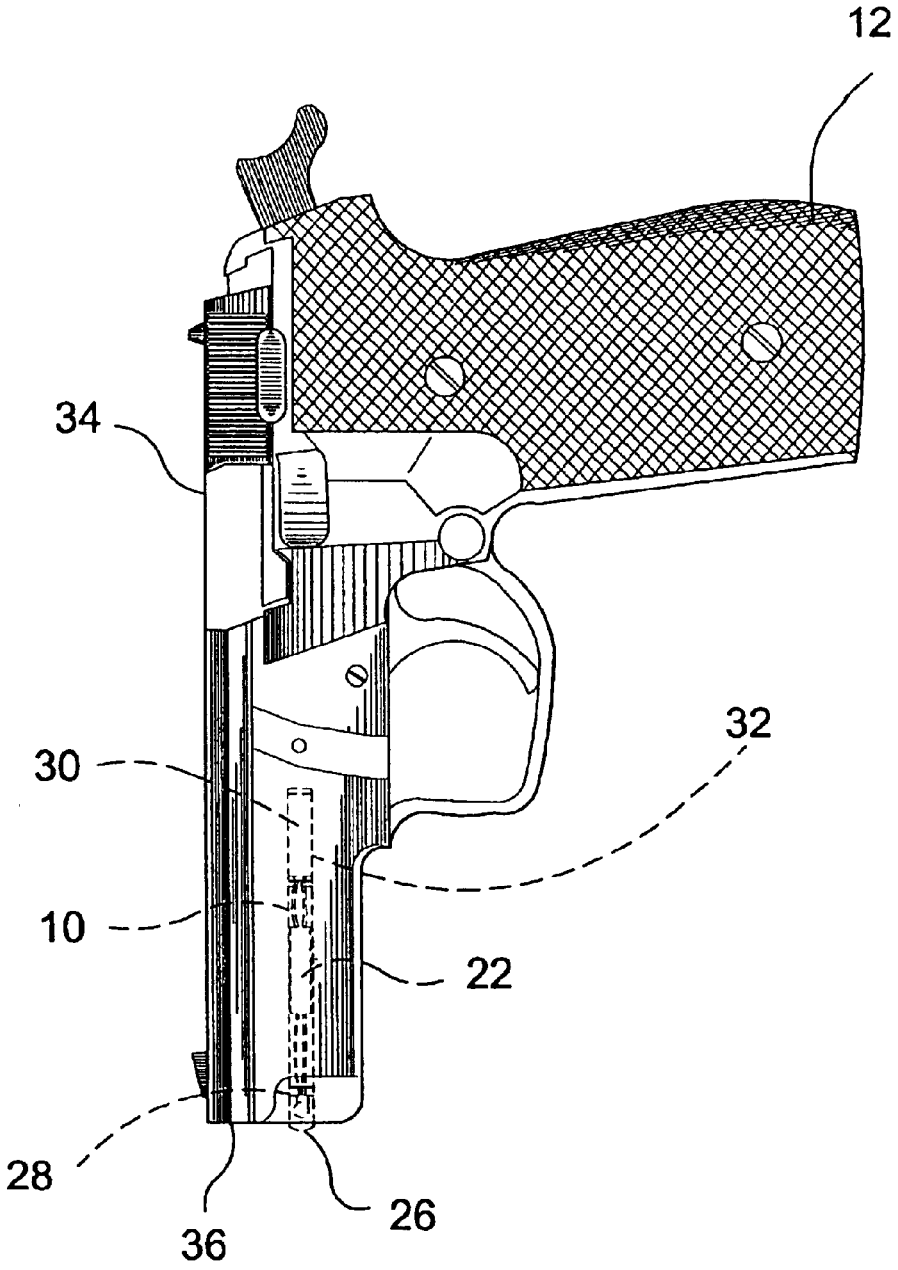
FIG. 3 is a side view of the present invention with guide rod light switch in the off position.

Turning to FIG. 3, shown therein is a side view of the present invention 10 with guide rod light tilt switch 22 in the off or holstered position. Shown is the first embodiment of the present invention 10, a semi automatic pistol 12 having the illuminating recoil guide rod 10 therein. A highly illuminating LED light 26 or infrared source for night vision is activated by a tilt or mercury switch 22 that allows for various angles of illumination when the firearm 12 is drawn from a holstered position, i.e., with the barrel pointing downward being in the vertical plane. The tilt switch 22 is powered by a battery 30 or batteries and is encompassed by an elongated compartment or housing 32 and disposed within an elongated cavity or bore of complementary size in the weapon 12, the bore being adjacent to and parallel to the barrel and disposed toward the front of the handgun. Also shown are the slide 34, barrel 36 and angle adjustment switch 28.

Figure 4:
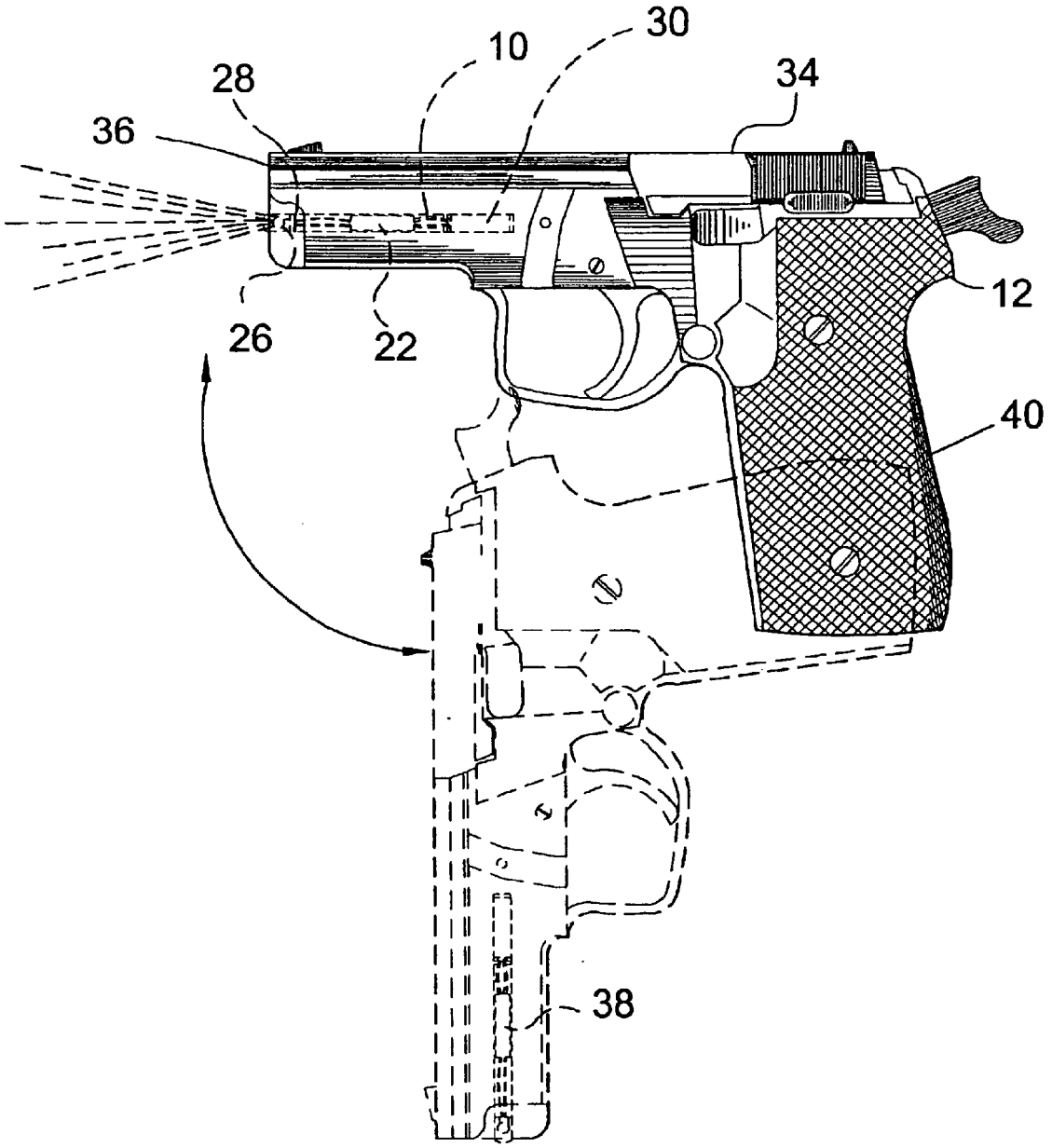
FIG. 4 is a side view of the present invention with illuminating guide rod light in the on position.

Turning to FIG. 4, shown therein is a side view of the present invention 10 with illuminating guide rod light 26 in the on or drawn position. Shown is a view of the first embodiment of the present invention 10, a semi automatic pistol 12 equipped with the modified illuminating recoil guide rod 10 and shown in phantom lines in the holstered position at 38 where the tilt or mercury switch 22 is in the off position. The invention is activated simply by drawing the weapon 12 from the holstered position to the drawn position with the barrel being in the horizontal plane as shown in solid lines at 40, without any other motion which activates the tilt or mercury switch 22 and illuminates the LED 26. Also shown are the barrel 36, angle adjustment switch 28, battery 30 and slide 34.

Figure 5:
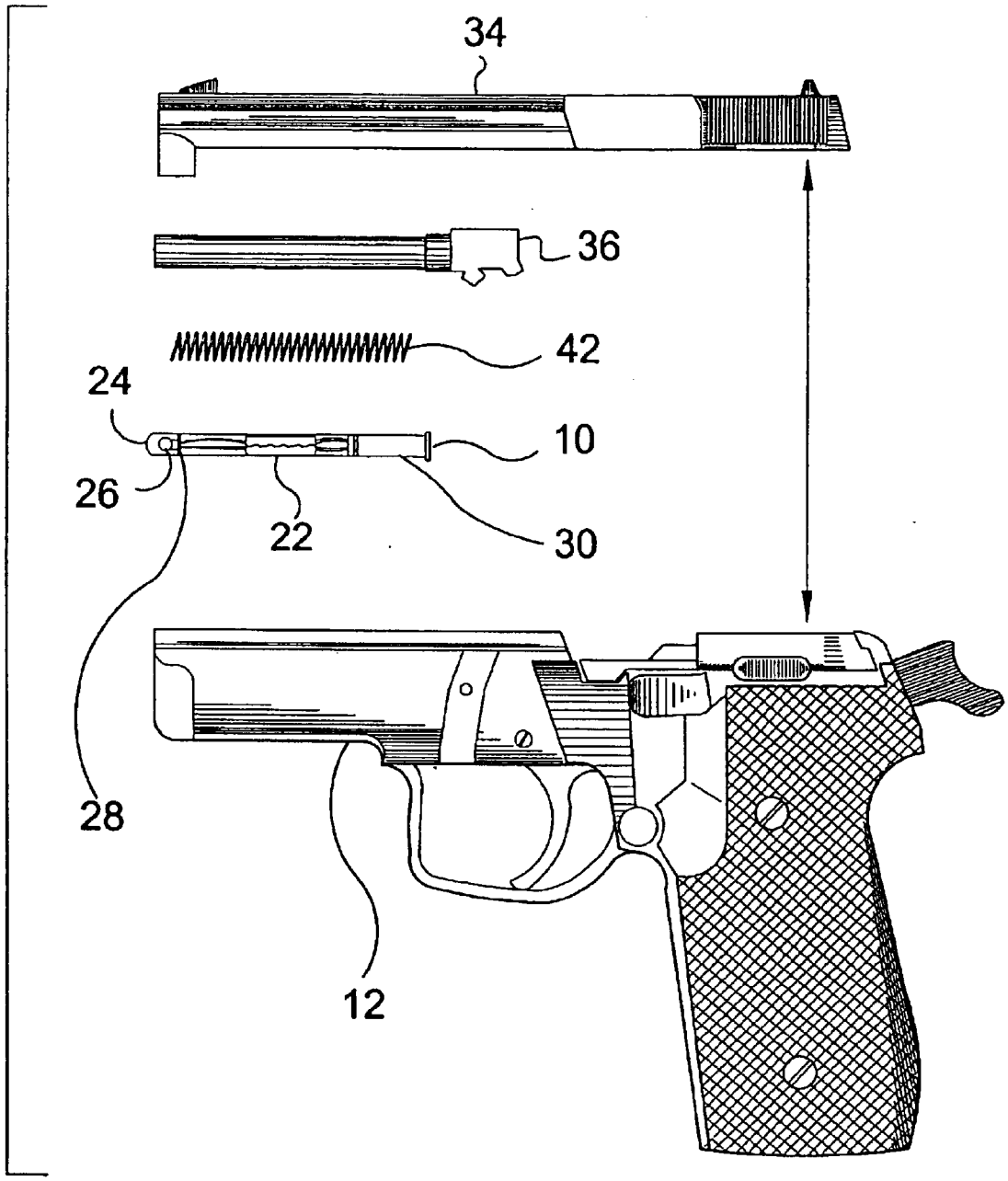
FIG. 5 is a side exploded view of the present invention.

Turning to FIG. 5, shown therein is a side exploded view of the present invention 10. Shown is a semi automatic pistol 12 with slide 34, barrel 36, recoil spring 42 and illuminating recoil guide 10 removed from the housing of the weapon 12. The modified illuminating recoil guide rod of the present invention 10 comprises a lens 24, a highly illuminating light 26, tilt or mercury switch 22, manual angle switch 28 and battery or batteries 30 encompassed within the recoil guide rod 10.

Figure 6:
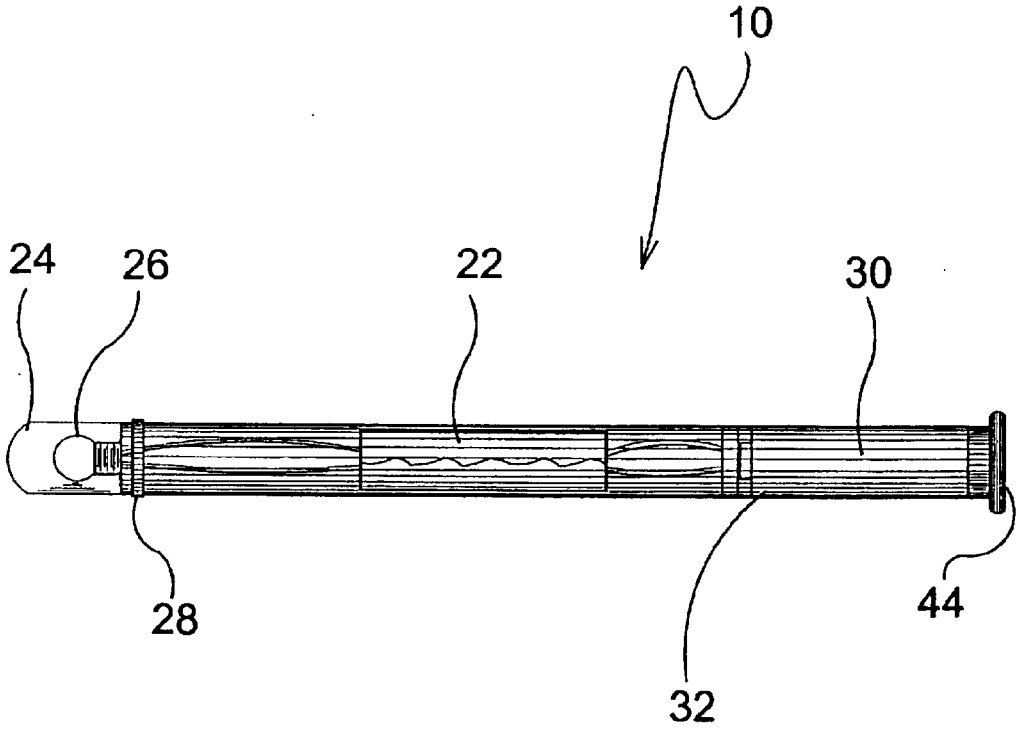
FIG. 6 is a side view of illuminating recoil guide rod.

Turning to FIG. 6, shown therein is a side view of the illuminating recoil guide rod 10. Shown is a side view of the illuminating recoil guide rod of the present invention 10 comprised of a housing 32, lens 24, highly illuminating LED light 26, tilt or mercury switch 22, manual angle switch 28 and battery or batteries 30. The battery or batteries 30 and other components can be removed for replacement through the illuminating guide rod end cap 44.

Figure 7:
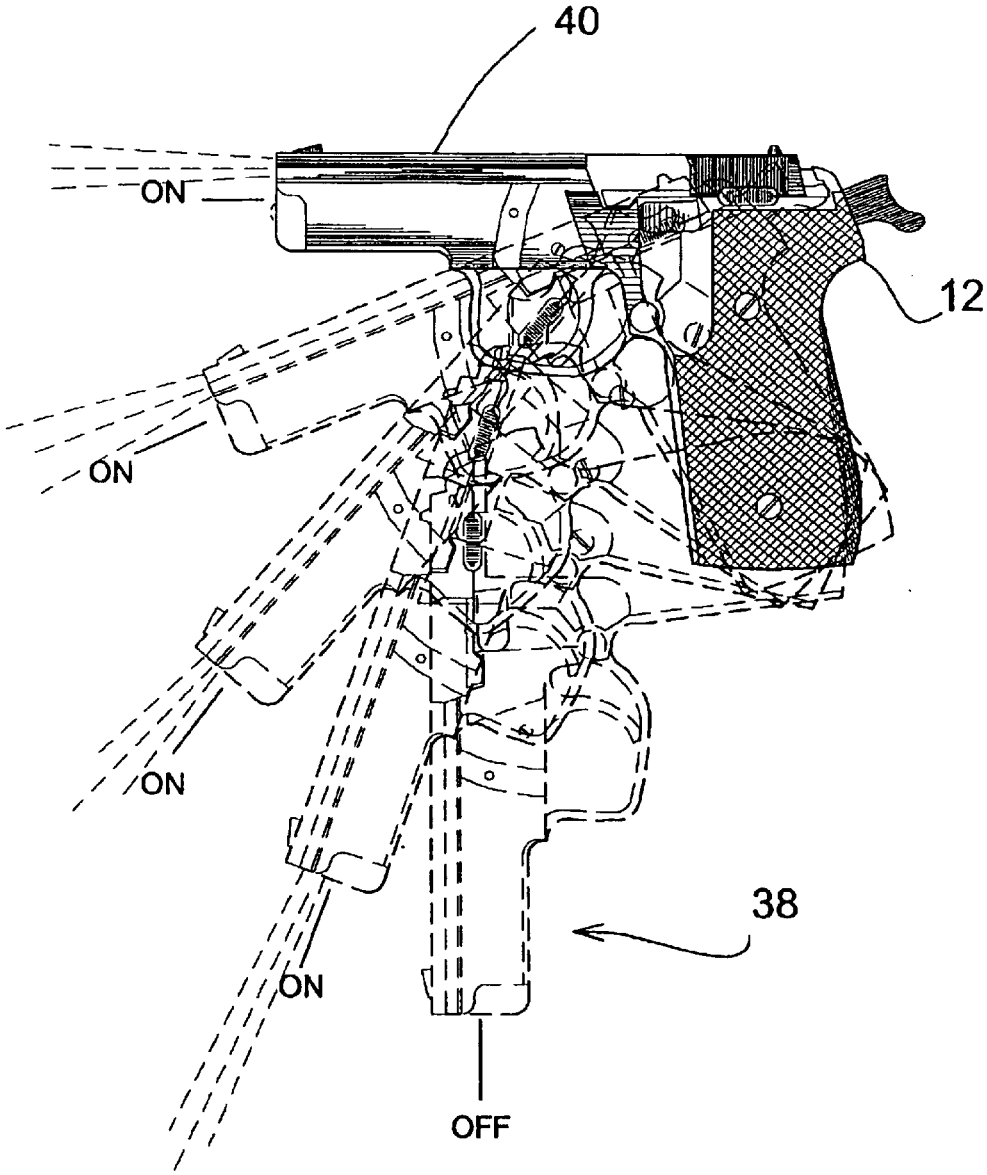
FIG. 7 is a side view of the present invention.

Turning to FIG. 7, shown therein is a side view of the present invention in use on handgun 12. Shown is a view of the first embodiment of the present invention, a semi automatic pistol 12 equipped with the modified illuminating recoil guide rod and shown moving from the off position 38 and passing through the various angles of on positions until it finally reaches the horizontal on position 40. The present invention is activated simply by drawing the weapon 12 from the holstered off position 38 without any other motion which activates the tilt or mercury switch and illuminates the LED. Also, it is expected that additional switches can be purchased to provide varying angles of illumination.

Figure 8:
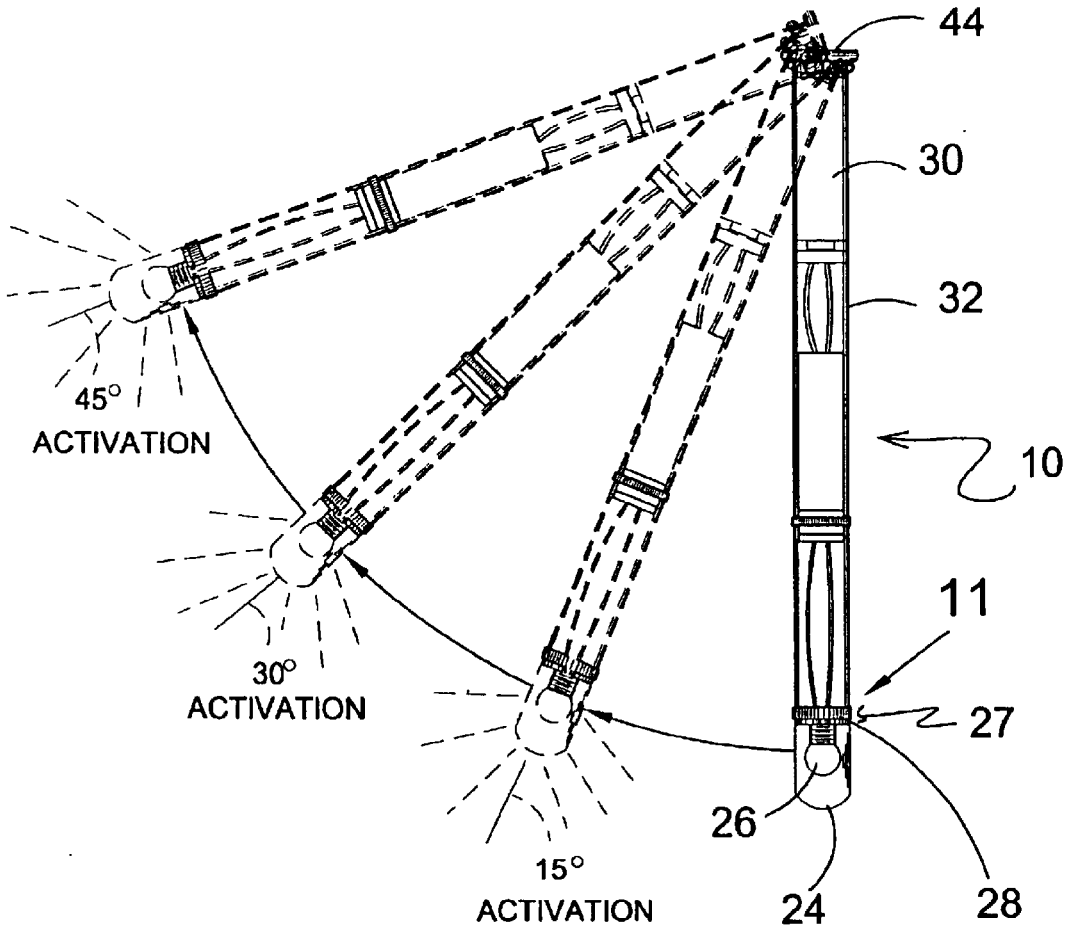
FIG. 8 is a side view of the present invention.

Turning to FIG. 8, shown therein is a side view of the present invention. Shown is a side view of the present invention comprising the illuminating recoil guide rod 10 that is provided in a kit featuring a manual shut off and angle adjustment switch 28 that can be set at a desired angle of illumination by rotating a dial 27 which is part of switch 28. It also serves as a manual shut off switch. Also shown are the lens 24, LED 26, end cap 44, battery 30 and the guide rod compartment or housing 32. Also shown is the activated LED at various degrees of angle.

Figure 9:
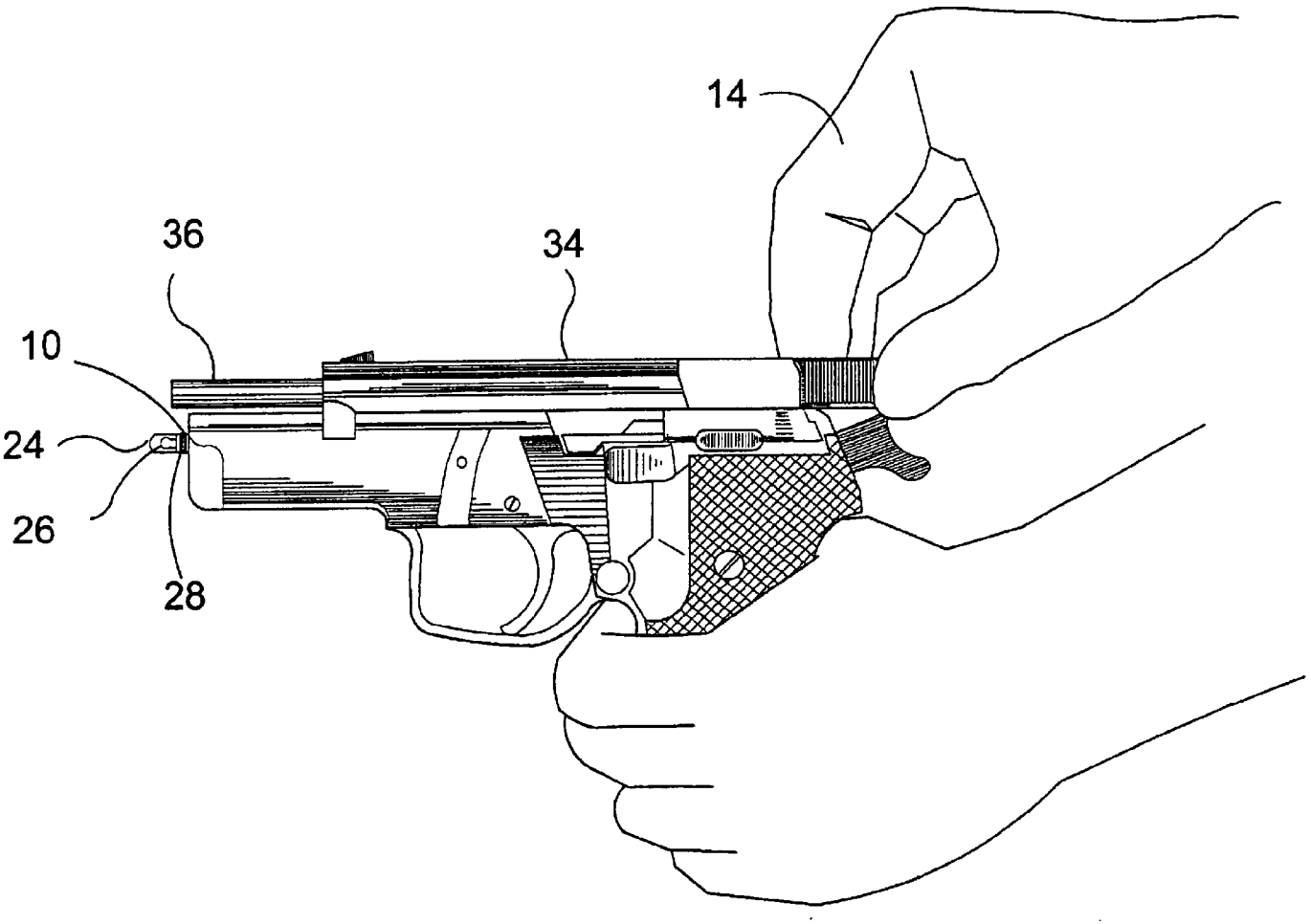
FIG. 9 is a side view of the present invention installed in a handgun.

Turning to FIG. 9, shown therein is a side view of the present invention installed in a handgun 12. Shown is a side view of the present invention in use wherein the slide 34 mechanism is pulled back slightly by user 14 to disengage the slide catch lever so the illuminating recoil guide rod 10 may then be adjusted to the selected position of illuminating angle or disengaged. Also shown are the barrel 36, lens 24, LED 26, and angle adjustment switch 28.

Figure 10:
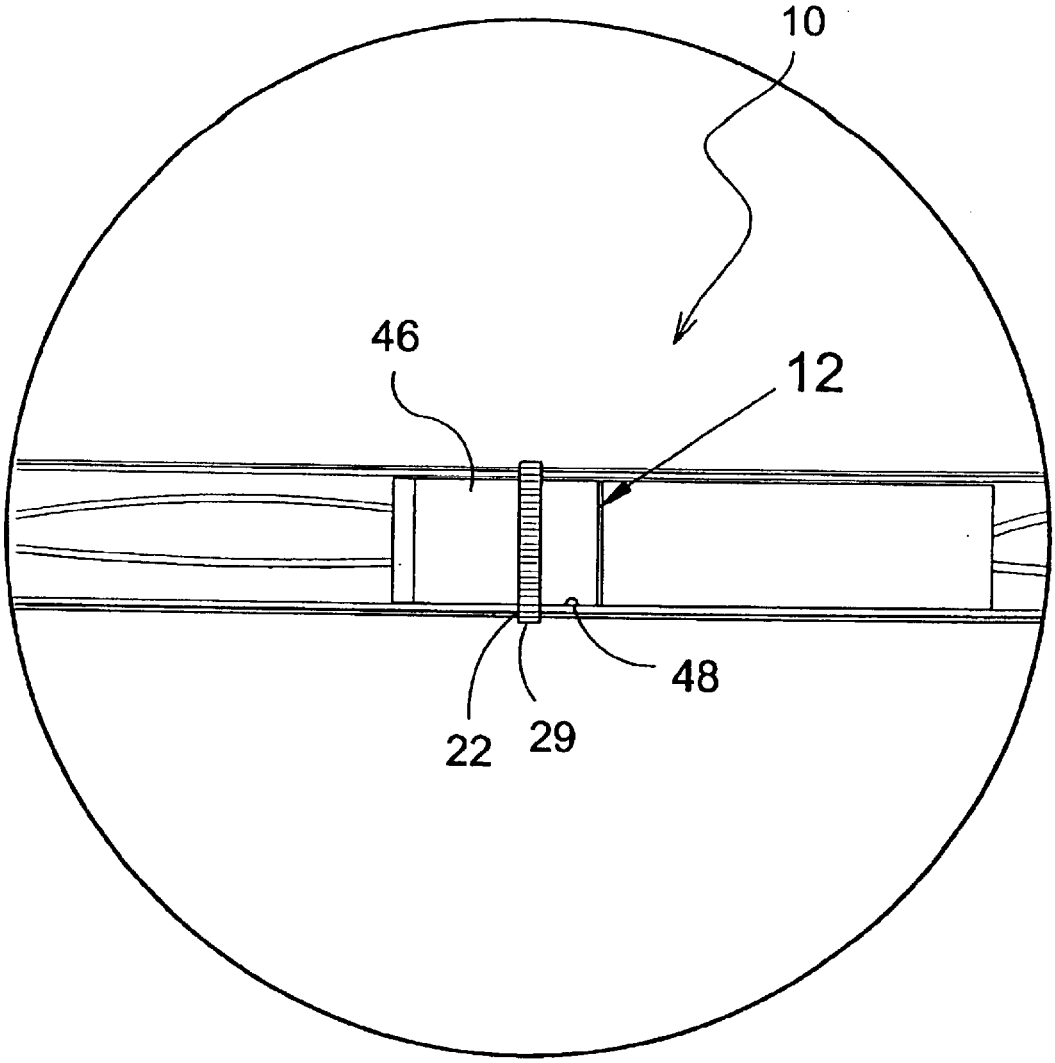
FIG. 10 is a enlarged partial view of the illuminating recoil guide rod.

Turning to FIG. 10, shown therein is an enlarged partial view of the illuminating recoil guide rod 10. Shown is a side view of the present invention 10, an illuminating recoil guide rod that is provided in a kit featuring an adjustable angle activation switch 22 with dial 29 that can be set at a desired angle of activation. It also serves as a manual shut off. Also shown are the mercury 46 and contact 48.

Figure 11:
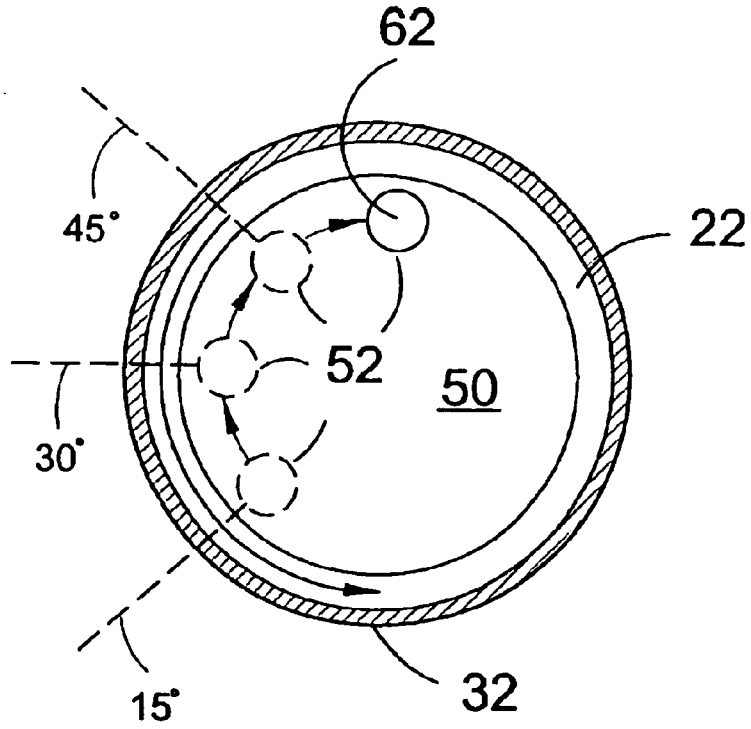
FIG. 11 is a view of the switch mechanism of the illuminating recoil guide rod.

Turning to FIG. 11, shown therein is a view of the angle adjustment switch 28 mechanism of the illuminating recoil guide rod. The switch 22 is comprised of a plate 50 having a plurality of ports 52 situated between electrically conductive mercury and a contact (not shown but see FIG. 12). Plate 50 is perpendicular to the longitudinal axis of housing 32 having the holes 52 spaced apart along about one-half of its outer periphery. When the mercury flows through the port and engages the contact a closed circuit is created and the LED is illuminated. When the handgun is holstered the mercury returns to the holding chamber creating an open circuit and the led is extinguished. The angle of illumination is selectively determined by rotating the dial until the desired point of illumination occurs and then leaving the positioning until a change is desired. The off position is shown at 62. Also shown is guide rod compartment 32.

Figure 12:
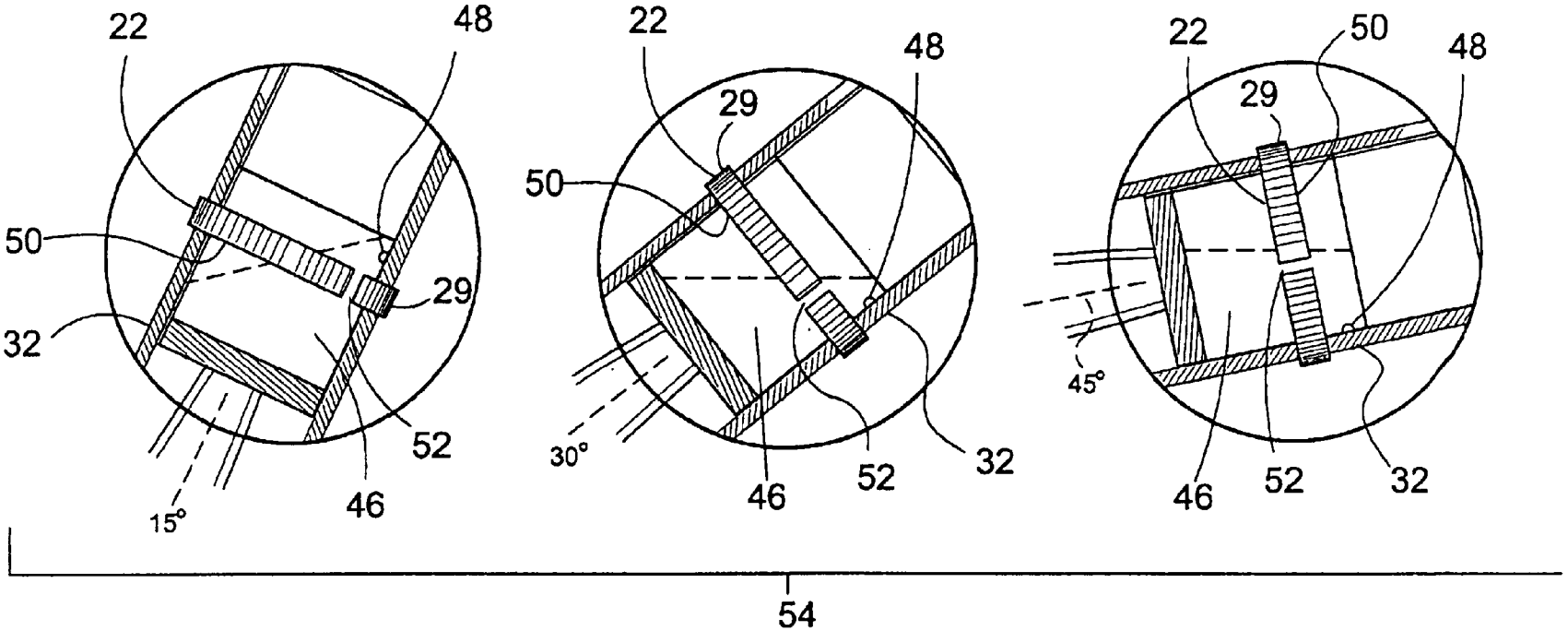
FIG. 12 is an illustrative view of various activation angles for illuminating the LED.

Turning to FIG. 12, shown therein is an illustrative view of various activation angles adjustments 54 for illuminating the LED. Shown are illustrative views of the present invention at different activation positions. The user can set the illuminating recoil guide rod manual switch 22 to a selected angle of activation by adjusting the manual switch, which rotates a port 52 that allows the mercury 46 to make contact with contact 48 and complete the circuit when the pistol reaches the desired angle. The manual switch 28 (not shown but see FIG. 8) also allows the user to shut it off as an added feature. The switch 22 is comprised of a plate 50 having a plurality of ports 52 situated between electrically conductive mercury 46 and a contact 48. When the mercury 46 flows from the front chamber through the port 52 into the rear chamber and engages the contact 48 a closed circuit is created and the LED is illuminated. When the handgun is holstered the mercury returns back to the front holding chamber creating an open circuit and the led is extinguished. The angle of illumination is selectively determined by rotating the dial 29 and associated ports 52 until the desired point of illumination occurs and then leaving the positioning until a change is desired. Also shown is guide rod compartment 32.

Figure 13:
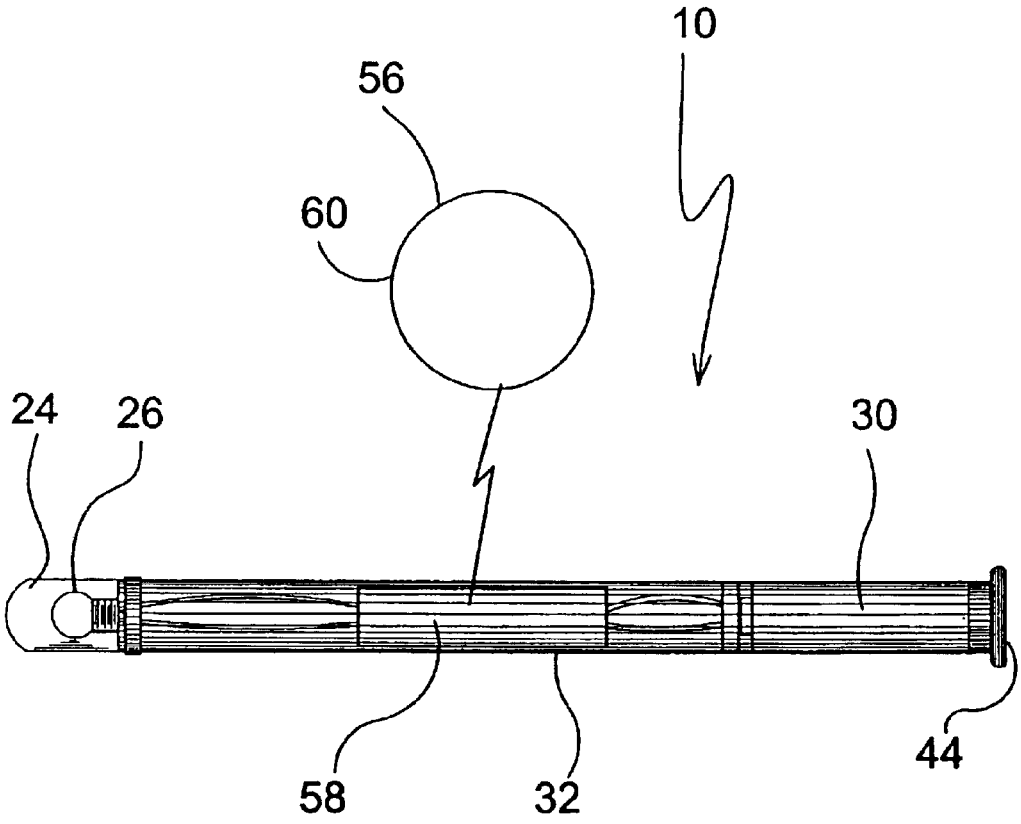
FIG. 13 is a side view of an alternate method of illuminating the LED.

Turning to FIG. 13, shown therein is a side view of an alternate method of illuminating the LED 26. Shown is a side view of the second embodiment of the present invention 10, a recoil guide rod 10 comprised of a lens 24, highly illuminating LED light 26, battery or batteries 30, wireless transmitter 56 and receiver 58. The transmitter 56 device is a wireless activation device and can be placed anywhere on the firearm to activate the recoil guide rod light 26. No shut off switch is necessary because the light 26 will only be active or on while pressure is being applied to the wireless pressure-activated or pressure sensitive transmitter pad 60 which may be an integral part of transmitter 56. Also shown is guide rod compartment 32 and end cap 44.

Figure 14:
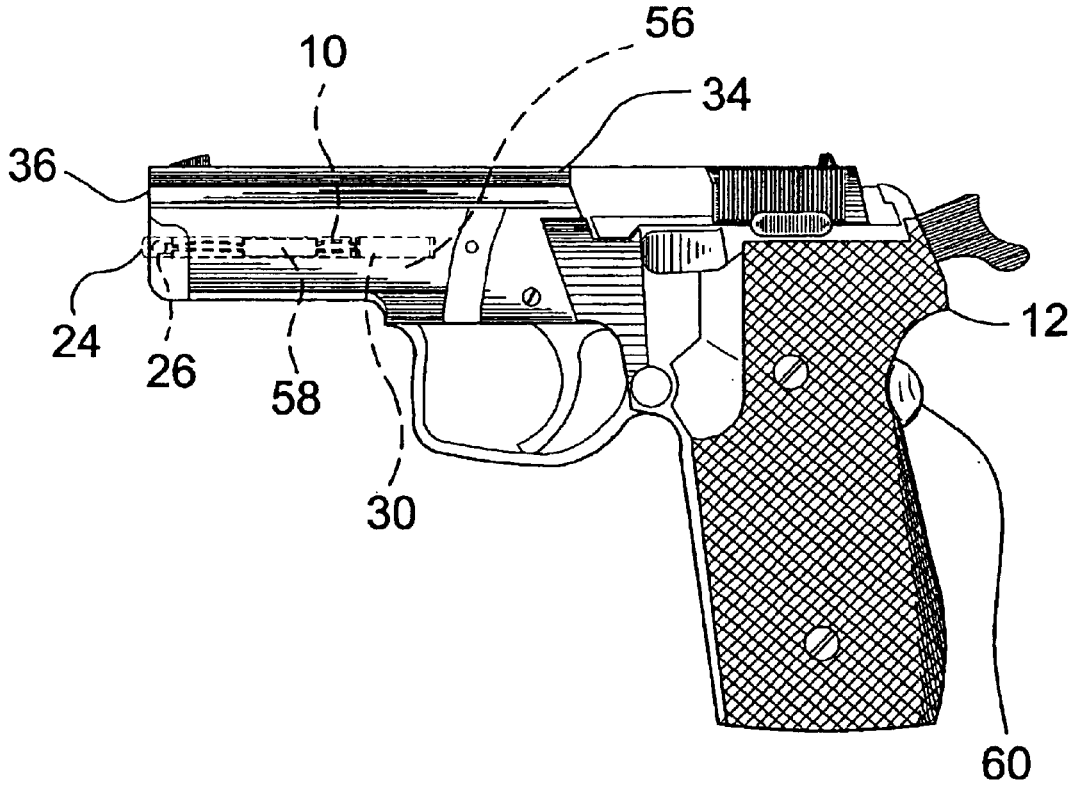
FIG. 14 is a side view of a handgun having the alternate illumination method therein.

Turning to FIG. 14, shown therein is a side view of a handgun 12 having the alternate illumination method therein. Shown is a side view of the second embodiment of the present invention, a recoil guide rod 10 comprised of a lens 24, highly illuminating LED light 26, battery or batteries 30, wireless transmitter 56 and receiver 58. The transmitter device 56 is a cordless activation device and can be placed anywhere on the firearm 12 to activate the recoil guide rod light 26. Also shown are the wireless transmitter pad 60, barrel 36 and slide 34.

I claim:

1. An apparatus for illuminating the target of a handgun, comprising:

a) a handgun, said handgun having a front end and a rear end, said handgun having a handle disposed on said rear end for a user to grasp and a barrel disposed on said front end for directing a projectile, said handgun having a bore therein, said bore being adjacent to and parallel to said barrel, said bore being disposed on said front end of said handgun;

b) a housing disposed in said bore, said housing having a front end and a rear opposing end;

c) a light disposed in said front end of said housing, said light for illuminating the target of the handgun, wherein said light illuminates a field having a specified angle of light projection;

d) a light angle adjustment switch to permit the angle of light projection which is illuminated to be varied;

e) means for activating said light including a mercury switch whereby the light is automatically activated by raising the barrel of the handgun from a holstered position to a drawn position;

f) a manual light shutoff switch to permit the light to be controlled manually regardless of the position of the barrel of the handgun; and, g) a power supply including at least one battery for operating the apparatus to permit a target to be illuminated;

h) a lens for placement over said light to permit the light to be protected; an end cap disposed on said rear end of said housing, wherein said light is a light emitting diode to permit the target to be illuminated said light being an infrared light to permit the target to be illuminated in darkness, wherein said mercury switch comprises:

i) a chamber disposed in said housing, said chamber having a first and second opposing end;

ii) a rotatable circular plate disposed in said chamber between said first and second ends, thereby forming a first front and second rear chamber, said plate being disposed perpendicular to the longitudinal axis of the housing, said plate having a plurality of spaced apart holes therein, said holes being disposed along about one-half of the outer periphery of the plate to permit mercury to flow therethrough as said handgun is raised from the holstered position to the drawn position iii) an electrical contact disposed in said rear chamber;

iv) wherein all the mercury is disposed in said front chamber when said barrel of said handgun is in the holstered position; and v) wherein said mercury passes through at least one of said holes in said plate as the handgun is raised from the holstered position to the drawn position, wherein said mercury physically contacts said contact completing an electrical circuit between said contact and said first front chamber and thereby between said light and said power supply causing said light to automatically light.

2. The apparatus of claim 1, wherein said plate can be rotated to vary the angle of the handgun at which mercury begins to flow through said holes.

3. An apparatus for illuminating the target of a handgun, comprising:

a) a handgun, said handgun having a front end and a rear end, said handgun having a handle disposed on said rear for a user to grasp and a barrel disposed on said front end for directing a projective, said handgun having a bore therein, said bore being adjacent to and parallel to said barrel, said bore being disposed on said front end of said handgun;

b) a housing disposed in said bore, said housing having a front end and a rear opposing end;

c) a light, said light is a light emitting diode to permit the target to be illuminated and disposed in said front end of said housing, said light for illuminating the target of the handgun wherein said light illuminates a field having a specified angle of light projection;

d) a receiver disposed in said housing for activating said light upon receiving a signal;

e) a transmitter disposed on said handgun for transmitting an activation signal to said receiver;

f) a transmitter pad disposed on said handgun, said pad for being activated by the user, wherein said pad activates said transmitter to transmit an activation signal to said receiver; and, g) a power supply including at least one battery for operating the apparatus to permit a target to be illuminated;

h) a lens for placement over said light to permit the light to be protected;

i) an end cap disposed on said rear end of said housing wherein said light is an infrared light to permit the target to be illuminated in darkness and said transmitter and said transmitter pad are integrally constructed.

4. The apparatus of claim 3, wherein said transmitter pad is pressure-activated by the user.

5. The apparatus of claim 4, wherein said transmitter pad is disposed on said handle of said handgun for being activated by the user.

6. The apparatus of claim 5, wherein said transmitter pad is activated to turn on said light only while pressure is being supplied to said pad by the user and allows said light to be turned off when pressure by the user is removed from said pad.

* * * * *